US011466881B2

(12) United States Patent
Hazui et al.

(10) Patent No.: US 11,466,881 B2
(45) Date of Patent: Oct. 11, 2022

(54) CONTROLLER AND METHOD FOR REDUCING STANDBY TIME WHEN CONTROLLING THE NUMBER OF CHILLERS TO BE OPERATED

(71) Applicant: MITSUBISHI HEAVY INDUSTRIES THERMAL SYSTEMS, LTD., Tokyo (JP)

(72) Inventors: Yusuke Hazui, Tokyo (JP); Koki Tateishi, Tokyo (JP); Satoshi Nikaido, Tokyo (JP); Yutaka Takenaka, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 136 days.

(21) Appl. No.: 16/956,774

(22) PCT Filed: Dec. 7, 2018

(86) PCT No.: PCT/JP2018/045126
§ 371 (c)(1),
(2) Date: Jun. 22, 2020

(87) PCT Pub. No.: WO2019/131065
PCT Pub. Date: Jul. 4, 2019

(65) Prior Publication Data

US 2021/0063037 A1 Mar. 4, 2021

(30) Foreign Application Priority Data

Dec. 27, 2017 (JP) ..... JP2017-251896

(51) Int. Cl.
*F24F 11/83* (2018.01)
*F25D 17/02* (2006.01)
(Continued)

(52) U.S. Cl.
CPC ..... *F24F 11/30* (2018.01); *F24F 11/83* (2018.01); *F25B 1/00* (2013.01); *F24F 11/85* (2018.01);
(Continued)

(58) Field of Classification Search
None
See application file for complete search history.

(56) References Cited

U.S. PATENT DOCUMENTS 10,174,986 B2 * 1/2019 Yokoyama ..... F25D 17/02
2004/0068996 A1 * 4/2004 Tseng ..... F25D 17/02 62/175
(Continued)

FOREIGN PATENT DOCUMENTS

JP 8-261544 A 10/1996
JP 2006-250443 A 9/2006
(Continued)

OTHER PUBLICATIONS

International Search Report and Written Opinion of the International Searching Authority for International Application No. PCT/JP2018/045126, dated Mar. 5, 2019, with an English translation.

*Primary Examiner* — Jerry-Daryl Fletcher
*Assistant Examiner* — Daniel C Comings
(74) *Attorney, Agent, or Firm* — Birch, Stewart, Kolasch & Birch, LLP

(57) ABSTRACT

A control device for a refrigerator system for cooling a load by using a plurality of refrigerators, said control device comprising a unit to control the number of operating units that changes the number of operating refrigerators according to the load rate, and a cold water temperature acquisition unit that acquires, via a temperature sensor, the temperature of cold water affected by the refrigerators. After a prescribed standby time from when the number of operating refrigera-
(Continued)

tors was changed has elapsed, the unit to control the number of operating units changes the number of operating units and reduces the prescribed standby time when at least one of the cold-water temperature and the rate of change in the cold-water temperature satisfies a prescribed condition.

9 Claims, 7 Drawing Sheets

(51) Int. Cl.

| | |
|---|---|
| ***F24F 11/30*** | (2018.01) |
| ***F25B 1/00*** | (2006.01) |
| *F24F 11/85* | (2018.01) |
| *F24F 140/50* | (2018.01) |
| *F24F 110/10* | (2018.01) |

(52) U.S. Cl.
CPC ..... *F24F 2110/10* (2018.01); *F24F 2140/50* (2018.01); *F25B 2500/27* (2013.01); *F25B 2600/01* (2013.01); *F25B 2600/23* (2013.01); *F25D 17/02* (2013.01)

(56) References Cited

U.S. PATENT DOCUMENTS

| | | | |
|---|---|---|---|
| 2014/0358253 | A1 | 12/2014 | Tateishi et al. |
| 2015/0211753 | A1 | 7/2015 | Ouchi et al. |
| 2017/0307247 | A1 | 10/2017 | Nikaido et al. |

FOREIGN PATENT DOCUMENTS

| | | | |
|---|---|---|---|
| JP | 2006-275492 | A | 10/2006 |
| JP | 4435533 | B2 | 3/2010 |
| JP | 2012-7871 | A | 1/2012 |
| JP | 5787792 | B2 | 9/2015 |
| JP | 2015-190654 | A | 11/2015 |
| JP | 2017-78522 | A | 4/2017 |
| JP | 2017-129340 | A | 7/2017 |
| WO | WO 2014/046208 | A1 | 3/2014 |
| WO | WO 2016/076068 | A1 | 5/2016 |

* cited by examiner

CONTROLLER AND METHOD FOR REDUCING STANDBY TIME WHEN CONTROLLING THE NUMBER OF CHILLERS TO BE OPERATED

Priority is claimed on Japanese Patent Application No. 2017-251896, filed on Dec. 27, 2017, the content of which is incorporated herein by reference.

TECHNICAL FIELD

The present invention relates to a control device, a chiller system, a control method, and a program.

BACKGROUND ART

When a chiller system including a plurality of chillers is operated, in order to efficiently operate the entire chiller system, control is performed to increase or decrease the number of the chillers to be operated (for example, refer to PTL 1 and PTL 2). In the chiller systems described in PTL 1 and PTL 2, each load factor range where a coefficient of performance (COP) of each of the chillers is a predetermined value or greater is determined, and the number of the chillers to be operated is controlled such that the load factor of each of the chillers falls within the determined load factor range.

In addition, in the chiller system described in PTL 1, a standby time for allowing the chiller to exhibit the capacity is provided before a determination on the next stage increase or decrease is performed once a stage increase or decrease (an increase or a decrease in the number of the chillers to be operated) occurs; and thereby, more suitable control is realized (refer to paragraph 0054 of PTL 1). This is to prevent an incident where when a determination on the next stage increase or decrease is performed in a state where the chiller does not exhibit the capacity and the system is in disorder, a load of the chiller does not fall within a desired load range during the time of settling after the number of the chillers to be operated is changed.

However, when the decrease rate of the load on the chiller system is rapid, there is a possibility that a proper stage decrease is not performed due to the foregoing standby time, and the chiller comes to a light load stop. The light load stop is a function of preventing a failure of the chiller which is due to a chilled water inlet temperature becoming low and an operation being performed in a state where the load is too low, and is a function provided in each of the chillers (for example, refer to paragraph 0008 of PTL 3). Since the light load stop is a function where a chiller main body stops by itself to prevent a failure, separately from an operation number control device, it is also considered that the plurality of chillers come to the light load stop at the same time. The reason the light load stop occurs despite operation number control being performed is that despite that the operation number control device has to originally determine a stage increase or decrease of the chiller, the chilled water inlet temperature decreases to a temperature where the chiller itself has to perform a stage decrease (stop) by itself. When the plurality of chillers come to the light load stop at the same time, a rapid change in the chilled water temperature is induced.

In order to prevent the light load stop, it is necessary to set the foregoing standby time to a short time and immediately determine a stage increase or decrease. However, in that case, even when there is no risk of the light load stop, there is a possibility that the operation number control where the load of the chiller does not fall within the desired load range is performed.

CITATION LIST

Patent Literature

[PTL 1] Japanese Examined Patent Application Publication No. 4435533

[PTL 2] Japanese Examined Patent Application Publication No. 5787792

[PTL 3] Japanese Unexamined Patent Application Publication No. 2017-129340

SUMMARY OF INVENTION

Technical Problem

The present invention provides a control device, a chiller system, a control method, and a program which are capable of solving the foregoing problems.

Solution to Problem

According to one aspect of the present invention, there is provided a control device of a chiller system that cools a load using a plurality of chillers, the device including: an operation number control unit that increases or decreases the number of the chillers to be operated according to a load factor; and a chilled water temperature acquisition unit that acquires a chilled water temperature related to the chiller from a temperature sensor. The operation number control unit increases or decreases the number of the chillers to be operated after a predetermined standby time has elapsed from when the number of the chillers to be operated is increased or decreased, and reduces the predetermined standby time when at least one of the chilled water temperature and a degree of change in the chilled water temperature satisfies a predetermined condition.

According to one aspect of the present invention, when at least one of the chilled water temperature and the degree of change in the chilled water temperature satisfies the predetermined condition, the operation number control unit sets the predetermined standby time to zero.

According to one aspect of the present invention, the predetermined condition is a condition for preventing a light load stop of the plurality of chillers.

According to one aspect of the present invention, the operation number control unit determines the predetermined condition based on a set value of the chilled water temperature when the light load stop is executed, which is received from the plurality of chillers.

According to one aspect of the present invention, the operation number control unit determines an amount of a reduction in the standby time based on the chilled water temperature, the degree of change in the chilled water temperature, and the set value.

According to one aspect of the present invention, the operation number control unit reduces the predetermined standby time when a chilled water temperature is lower than a predetermined set value, as the predetermined condition.

According to one aspect of the present invention, the operation number control unit reduces the predetermined standby time when a decrease rate of the chilled water temperature is greater than a predetermined set value, as the predetermined condition.

According to one aspect of the present invention, there is provided a chiller system including a plurality of chillers that cool a load; and a control device that includes an operation number control unit which increases or decreases the number of the chillers to be operated according to a load factor, and a chilled water temperature acquisition unit which acquires a chilled water temperature related to the chiller from a temperature sensor and that controls the plurality of chillers. The operation number control unit increases or decreases the number of the chillers to be operated after a predetermined standby time has elapsed from when the number of the chillers to be operated is increased or decreased, and reduces the predetermined standby time when at least one of the chilled water temperature and a degree of change in the chilled water temperature satisfies a predetermined condition.

According to one aspect of the present invention, there is provided a control method using a control device of a chiller system that cools a load using a plurality of chillers, which includes an operation number control unit that increases or decreases the number of the chillers to be operated according to a load factor, and a chilled water temperature acquisition unit which acquires a chilled water temperature related to the chiller from a temperature sensor, the method including: causing the operation number control unit to increase or decrease the number of the chillers to be operated after a predetermined standby time has elapsed from when the number of the chillers to be operated is increased or decreased, and to reduce the predetermined standby time when at least one of the chilled water temperature and a degree of change in the chilled water temperature satisfies a predetermined condition.

According to one aspect of the present invention, there is provided a program that causes a computer, which forms a control device of a chiller system that cools a load using a plurality of chillers, the control device including an operation number control unit that increases or decreases the number of the chillers to be operated according to a load factor, and a chilled water temperature acquisition unit that acquires a chilled water temperature related to the chiller from a temperature sensor, to control the operation number control unit to execute: increasing or decreasing the number of the chillers to be operated after a predetermined standby time has elapsed from when the number of the chillers to be operated is increased or decreased, and reducing the predetermined standby time when at least one the chilled water temperature and a degree of change in the chilled water temperature satisfies a predetermined condition.

Advantageous Effects of Invention

According to the control device, the chiller system, the control method, and the program which are described above, it is possible to both ensure the stability of operation number control and prevent a light load stop.

DESCRIPTION OF EMBODIMENTS

Figure 1:
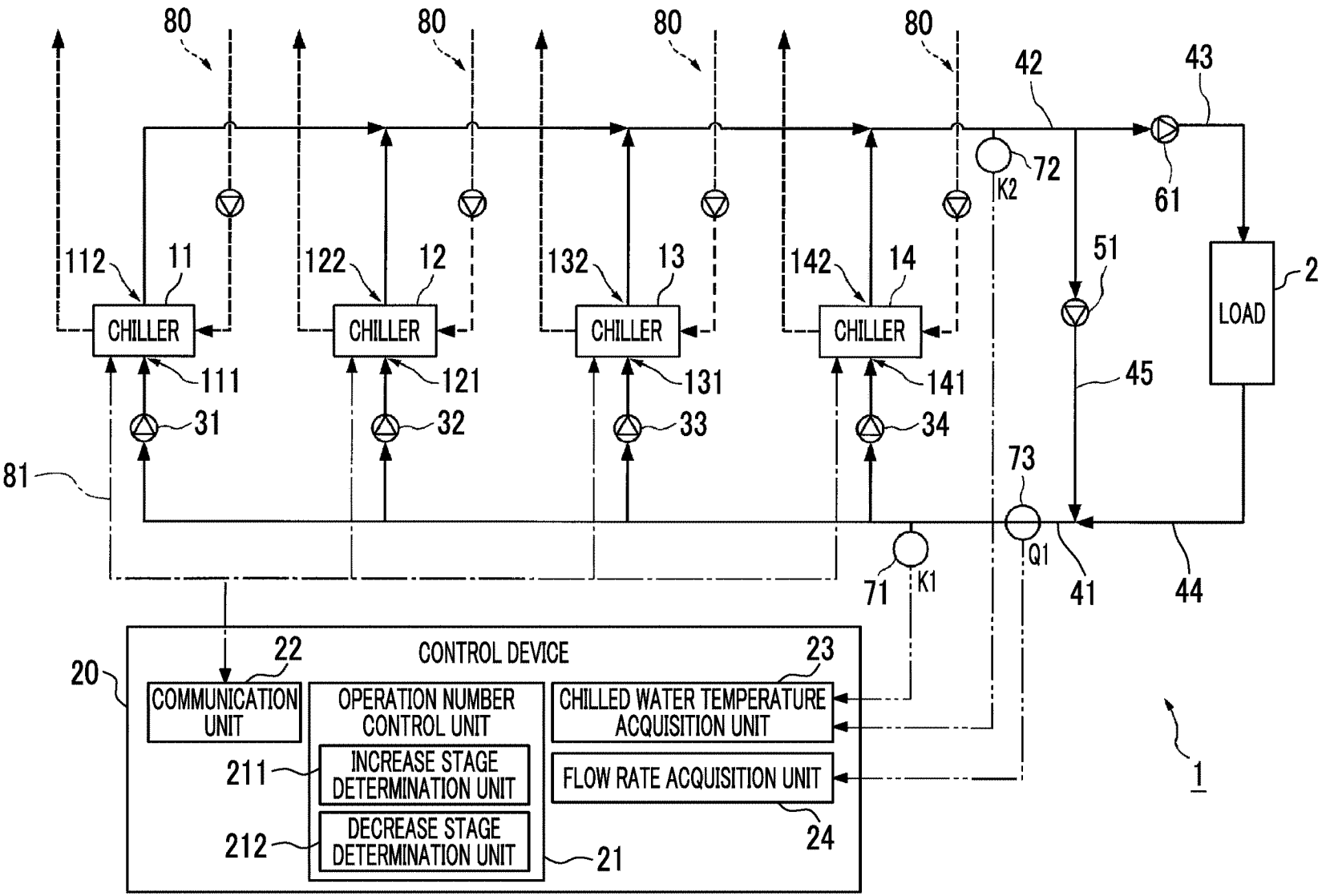
FIG. 1 is a diagram illustrating a configuration example of a chiller system including a plurality of chillers according to an embodiment of the present invention.

FIG. 1 is a diagram schematically illustrating the configuration of a chiller system 1 according to one embodiment of the present invention. The chiller system 1 includes four chillers 11, 12, 13, and 14 and a control device 20. The four chillers 11, 12, 13, and 14 decrease the temperature of chilled water that is supplied to a load 2 such as a refrigeration or chilling display case, an air conditioner, a water heater, or factory equipment. The chilled water flowing through a pipe 41 flows into chilled water inlets 111, 121, 131, and 141 of the chillers 11, 12, 13, and 14 via pumps 31, 32, 33, and 34. The chilled water of which the temperature is lowered by the chillers 11, 12, 13, and 14 is sent from chilled water outlets 112, 122, 132, and 142 to the load 2 via a pipe 42, a pump 61, and a pipe 43. The chilled water that is return water via the load 2 returns to the pipe 41 via a pipe 44. A bypass pipe 45 and a pump 51 are provided between the pipe 42 and the pipe 41, and a part of the chilled water flowing through the pipe 42 returns to the pipe 41 without passing through the load 2.

The pipe 41 is provided with a temperature sensor 71 and a flow rate sensor 73. The temperature sensor 71 measures a temperature K1 of the chilled water flowing through the pipe 41, to output a measurement result to the control device 20. The temperature K1 of the chilled water which is measured by the temperature sensor 71 is substantially the same as the temperature of the chilled water flowing into the chillers 11 to 14 from the chilled water inlets 111, 121, 131, and 141. The flow rate sensor 73 measures a flow rate Q1 of the chilled water flowing through the pipe 41, to output a measurement result to the control device 20. The flow rate Q1 of the chilled water which is measured by the flow rate sensor 73 is the total flow rate of the chilled water that flows into the chillers 11 to 14 from the chilled water inlets 111, 121, 131, and 141. The pipe 42 is provided with a temperature sensor 72. The temperature sensor 72 measures a temperature K2 of the chilled water flowing through the pipe 42, to output a measurement result to the control device 20. The temperature K2 of the chilled water which is measured by the temperature sensor 72 substantially coincides with temperatures at the chilled water outlets of the chillers 11, 12, 13, and 14 in operation.

The chillers 11, 12, 13, and 14 are, for example, centrifugal chillers, and transmit and receive a predetermined control signal to and from the control device 20 via a communication line 81 to operate under control by the control device 20. The chillers 11, 12, 13, and 14 start, for example, when receiving a start signal from the control device 20. In addition, the chillers 11, 12, 13, and 14 stop when receiving a stop signal from the control device 20. In addition, in response to a predetermined inquiry from the control device 20, the chillers 11, 12, 13, and 14 transmit information, which indicates the set value of the chilled water temperature when a light load stop is executed, to the control device 20. The light load stop is a function where even though the chillers 11, 12, 13, and 14 do not receive a stop signal from the control device 20, the chillers 11, 12, 13, and 14 individually stop operating when the chilled water temperatures thereof are predetermined set values or less. The chillers 11, 12, 13, and 14 have the light load stop function. The predetermined set values are the set values of the chilled water temperature which are measured at the chilled water inlets 111, 121, 131, and 141, or the set values of the chilled water temperature which are measured at the chilled water outlets 112, 122, 132, and 142. When the chillers 11, 12, 13, and 14 transmit the information, which indicates the set values of the chilled water temperature when the light load stop is executed, to the control device 20, the chillers 11, 12, 13, and 14 may transmit information, which indicates the set values at the chilled water inlets or the set values at the chilled water outlets, to the control device 20. A cooling water system 80 is connected to the chillers 11, 12, 13, and 14, and a cooling water circulates through the chillers 11, 12, 13, and 14.

The control device 20 is, for example, a computer, and includes a central processing unit (CPU), a main storage device, an auxiliary storage device, a communication device, an input and output device, and the like. The auxiliary storage device stores a program and data, and the CPU executes the program to configure various functions in combinations of hardware and software. The control device includes an operation number control unit 21, a communication unit 22, a chilled water temperature acquisition unit 23, and a flow rate acquisition unit 24 which are function blocks indicating the functions. The operation number control unit 21 includes an increase stage determination unit 211 and a decrease stage determination unit 212.

The communication unit 22 transmits and receives a predetermined control signals to and from the chillers 11, 12, 13, and 14 via the communication line 81. The chilled water temperature acquisition unit 23 receives information indicating the measurement results output from the temperature sensor 71 and the temperature sensor 72. The flow rate acquisition unit 24 receives information indicating the measurement result output from the flow rate sensor 73.

Figure 2:
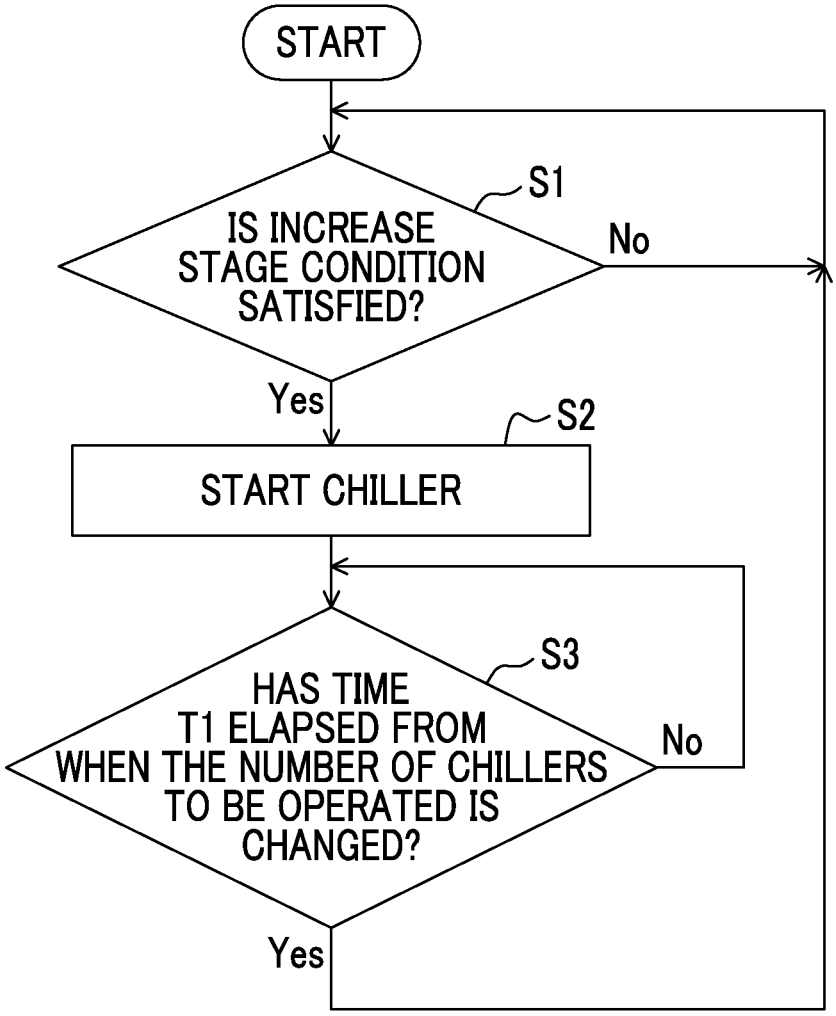
FIG. 2 is a flowchart illustrating an operation example of a control device 20 illustrated in FIG. 1.
Figure 3:
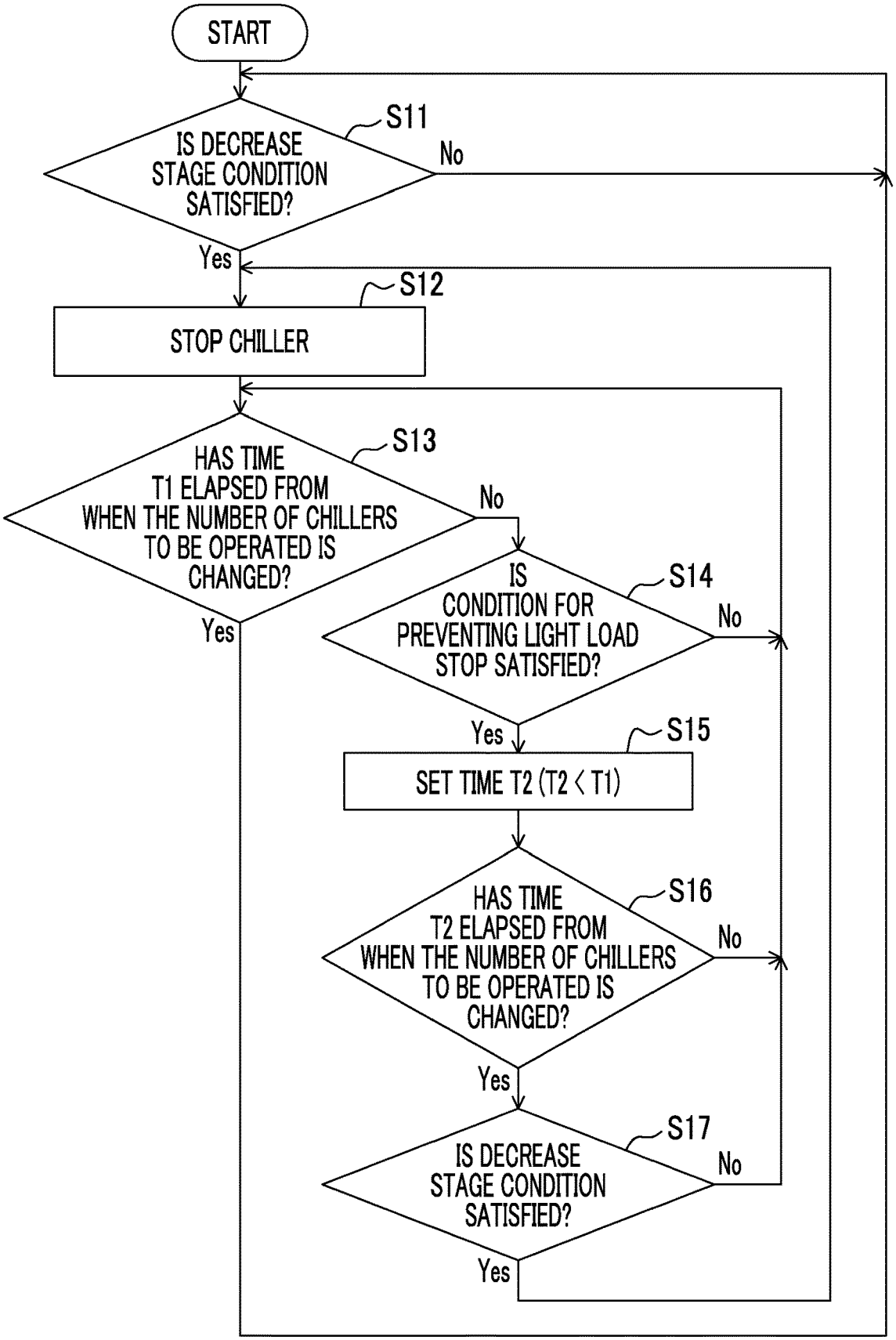
FIG. 3 is a flowchart illustrating an operation example of the control device 20 illustrated in FIG. 1.

The operation number control unit 21 causes the increase stage determination unit 211 and the decrease stage determination unit 212 to increase or decrease the number of the chillers 11, 12, 13, and 14 to be operated according to a load factor. Operation examples of the increase stage determination unit 211 and the decrease stage determination unit 212 will be described with reference to FIGS. 2 and 3. FIG. 2 is a flowchart illustrating an operation example of the increase stage determination unit 211. FIG. 3 is a flowchart illustrating an operation example of the decrease stage determination unit 212.

As illustrated in FIG. 2, firstly, the increase stage determination unit 211 determines whether or not a predetermined increase stage condition is satisfied (step S1). When the predetermined increase stage condition is not satisfied (in the case of "No" in step S1), the increase stage determination unit 211 determines whether or not the predetermined increase stage condition is satisfied (step S1), in a repeated manner at predetermined periods.

On the other hand, when the predetermined increase stage condition is satisfied (in the case of "Yes" in step S1), the increase stage determination unit 211 transmits a start signal from the communication unit 22 to start one of the chillers 11 to 14 which has not started (step S2).

Subsequently, the increase stage determination unit 211 determines whether or not a time T1 (predetermined standby time) has elapsed from when the number of the chillers to be operated is changed (step S3). When the time T1 has not elapsed from when the number of the chillers to be operated is changed (in the case of "No" in step S3), the increase stage determination unit 211 determines whether or not the time T1 has elapsed, in a repeated manner at predetermined periods (step S3).

On the other hand, when the time T1 has elapsed after the number of the chillers to be operated has been changed (in the case of "Yes" in step S3), the increase stage determination unit 211 again determines whether or not the predetermined increase stage condition is satisfied (step S1).

In the above process, when the number of the chillers to be operated is changed, the increase stage determination unit 211 determines whether or not the increase stage condition is satisfied, after the time T1 has elapsed. Therefore, when the number of the chillers to be operated is changed, the next stage increase of the chillers is executed at least with an interval of the time T1.

The predetermined increase stage condition is, for example, a condition where the load factor is higher than a predetermined range. Here, the load factor is a ratio between the amount of heat supplied to the chilled water by the load 2 or the like and the total value of the rated outputs of the chillers in operation. The amount of heat supplied by the load 2 or the like is obtained by multiplying a difference between the temperature K1 and the temperature K2 by the flow rate Q1 and a specific heat C, namely, is obtained by (the temperature K1−the temperature K2)×the flow rate Q1×the specific heat C. The time T1 is appropriately set depending on the configuration of the system, and can be, for example, approximately several tens to several hundreds of seconds.

On the other hand, as illustrated in FIG. 3, firstly, the decrease stage determination unit 212 determines whether or not a predetermined decrease stage condition is satisfied (step S11). When the predetermined decrease stage condition is not satisfied (in the case of "No" in step S11), the decrease stage determination unit 212 determines whether or not the predetermined decrease stage condition is satisfied, in a repeated manner at predetermined periods (step S11). Here, the predetermined decrease stage condition is, for example, a condition where the foregoing load factor is lower than a predetermined range.

On the other hand, when the predetermined decrease stage condition is satisfied (in the case of "Yes" in step S11), the decrease stage determination unit 212 transmits a stop signal from the communication unit 22 to stop one of the chillers 11 to 14 which has started (step S12).

Subsequently, the decrease stage determination unit 212 determines whether or not the time T1 (predetermined standby time) has elapsed from when the number of the chillers to be operated is changed (step S13). When the time T1 has elapsed from when the number of the chillers to be operated is changed (in the case of "Yes" in step S13), the decrease stage determination unit 212 again determines whether or not the predetermined decrease stage condition is satisfied (step S11).

On the other hand, when the time T1 has not elapsed from the number of the chillers to be operated is changed (in the case of "No" in step S13), the decrease stage determination unit 212 determines whether or not a condition for preventing a light load stop is satisfied (step S14). The condition for preventing a light load stop is a condition where the current operating state is a state where when the operation continues without a stage decrease, the probability of occurrence of a light load stop in the chiller in operation increases to a certain degree. This state is a state where it is desirable that a stage decrease is performed immediately without waiting for the elapse of the time T1 or after a standby time T2 shorter than the time T1 to prevent the occurrence of a light load stop.

For example, the condition for preventing a light load stop can be set as follows.

(1) A condition where the chilled water temperature (at least one of the temperature K1 and the temperature K2 (hereinafter, the same is applied) is lower than a predetermined set value (set value of the temperature) C1 can be set as the prevention condition.

(2) A condition where the condition described in (1) or the chilled water temperature is a predetermined set value C2 (C2>C1) or less and a degree of change D1 of the chilled water temperature is a predetermined set value C3 or greater can be set as the prevention condition. The degree of change D1 of the chilled water temperature can be defined as, for example, the rate of decrease of the chilled water temperature per unit time (° C./min). For example, a condition where "the chilled water inlet temperature K1 is "C1"° C. or less" or "the chilled water inlet temperature K1 is "C2"° C. or less (C2>C1)" and "the decrease rate D1 of the chilled water inlet temperature is "C3"° C./min or greater" can be set as the prevention condition. For example, C1, C2, and D1 can be set to 8.0, 8.5, and 0.5, respectively (However, this is a case where it is assumed that the rated chilled water temperature of the chiller is from 12° C. to 7° C. and the light load stop temperature is 7.5° C.)

(3) A condition where the temperature approaches set temperatures for a light load stop which are received from the chillers 11 to 14 can be set as the prevention condition. For example, a condition where when the highest set temperature of the chiller in operation among the set temperatures for a light load stop which are received from the chillers 11 to 14 is "X"° C., the chilled water temperature is "X"° C.+"G"° C. or less, or the chilled water temperature is "X"° C.×"H" or less ("H" is an integer greater than one) can be set as the prevention condition. For example, in a case of X=7.5 and G=0.5, when the temperature K1 or the temperature K2 is "8.0"° C. or less, the prevention condition is satisfied. Alternatively, for example, in a case of X=7.5 and H=1.1, when the temperature K1 or the temperature K2 is "8.25"° C. or less, the prevention condition is satisfied.

Whether or not to perform a light load stop is controlled by, for example, the chilled water inlet temperature. For this reason, in order to prevent the light load stop, it is reasonable that a chilled water inlet temperature to switch between the standby times for operation number control or a decrease rate of the chilled water inlet temperature is determined based on the chilled water inlet temperature which leads to the light load stop. In this prevention condition, for example, an operation number control device receives a set value of the chilled water inlet temperature, which leads to the light load stop, from the chiller to determine the foregoing chilled water inlet temperature and the foregoing decrease rate of the chilled water inlet temperature based on the temperature. In this prevention condition, a threshold value of the chilled water inlet temperature to switch between the standby times for the operation number control or the decrease rate of the chilled water temperature is determined based on the chilled water inlet temperature which leads to the light load stop; and thereby, it is possible to more reliably prevent the light load stop.

(4) In (2), the degree of change D1 of the chilled water temperature can be set to a value where a current chilled water temperature (K1 or K2) reaches the set temperatures for a light load stop, which are received from the chillers 11 to 14, in "Z" minutes. "Z" can be set to, for example, 5 minutes.

By the way, in FIG. 3, when the condition for preventing a light load stop is not satisfied (in the case of "No" in step S14), the decrease stage determination unit 212 again determines whether or not the time T1 has elapsed from when the number of the chillers to be operated is changed (step S13). On the other hand, when the condition for preventing a light load stop is satisfied (in the case of "Yes" in step S14), the decrease stage determination unit 212 sets the time T2 (step S15). The time T2 is a standby time shorter than the time T1. Namely, the time T2 is a standby time obtained by reducing the time T1. The time T2 is a time which is zero seconds or greater, and may be a fixed value or may be dynamically changed. The fact that the time T2 is zero implies that a next decrease stage condition can be determined immediately after the number of operating stages of the chillers is changed. When the time T2 is a fixed value, the process in step S15 can be omitted.

For example, the time T2 can be dynamically determined as follows. Namely, the decrease stage determination unit 212 (operation number control unit 21) can determine the time T2 based on the chilled water temperature, the degree of change of the chilled water temperature, and the set value of the chilled water temperature for a light load stop (namely, it is possible to determine the amount of a reduction in the standby time T1). For example, the standby time is calculated from "the current chilled water inlet temperature K1", "the current decrease rate D1 of the chilled water inlet temperature", and "a set value X1 of the chilled water inlet temperature which is received from the chiller to lead to a light load stop". It is possible to derive whether or not the chiller comes to a light load stop in "a" minutes, using the equation "a=(K1−X1)÷D1" from these three types of numerical values. The time T2 is set shorter than the standby time "a".

It is also possible to determine how short the standby time has to be based on "how many chillers are to be stopped at the maximum for a minutes". For example, in a case where it is calculated that the chillers come to a light load stop in five minutes, and when it is desired to stop a maximum of three chillers in five minutes, 300 seconds (5 minutes) ÷3=100 seconds is set as the standby time T2.

When the chilled water inlet temperature or the decrease rate of the chilled water inlet temperature satisfy the conditions and the standby time is shortened, it is not simple how to set a standby time after the shortening. However, when the time T2 is determined as described above, the standby time after the shortening can be determined based on a temperature where the chiller actually comes to a light load stop, or the like.

When the time T2 is set in step S15, the decrease stage determination unit 212 determines whether or not the time T2 has elapsed from when the number of the chillers to be operated is changed (step S16). When the time T2 has not elapsed from when the number of the chillers to be operated is changed (in the case of "No" in step S16), the decrease stage determination unit 212 again determines whether or not the time T1 has elapsed from when the number of the chillers to be operated is changed (step S13). On the other hand, when the time T2 has elapsed from when the number of the chillers to be operated is changed (in the case of "Yes" in step S16), the decrease stage determination unit 212 determines whether or not the predetermined decrease stage condition is satisfied (step S17). The predetermined decrease stage condition is the same in step S11 and step S17.

When the predetermined decrease stage condition is not satisfied (in the case of "No" in step S17), the decrease stage determination unit 212 again determines whether or not the time T1 has elapsed from when the number of the chillers to be operated is changed (step S13). On the other hand, when the predetermined decrease stage condition is satisfied (in the case of "Yes" in step S17), the decrease stage determination unit 212 transmits a stop signal from the communication unit 22 to stop one of the chillers 11 to 14 which has started (step S12).

In the above process, when the number of the chillers to be operated is changed, before the time T1 elapses, the decrease stage determination unit 212 determines whether or not the condition for preventing a light load stop is satisfied, and when the condition for preventing a light load stop is satisfied, the decrease stage determination unit 212 changes the standby time to the standby time T2 obtained by reducing the standby time T1, to determine whether or not the decrease stage condition is satisfied. Therefore, when the number of the chillers to be operated is changed, the next stage decrease of the chillers is executed with an interval of the time T1 or the time T2 (zero or greater and less than T1). Therefore, according to the present embodiment, even when the load decreases rapidly, it is possible to prevent the light load stop of the chillers. It is possible to both ensure the stability of the operation number control and prevent a light load stop.

Figure 4:
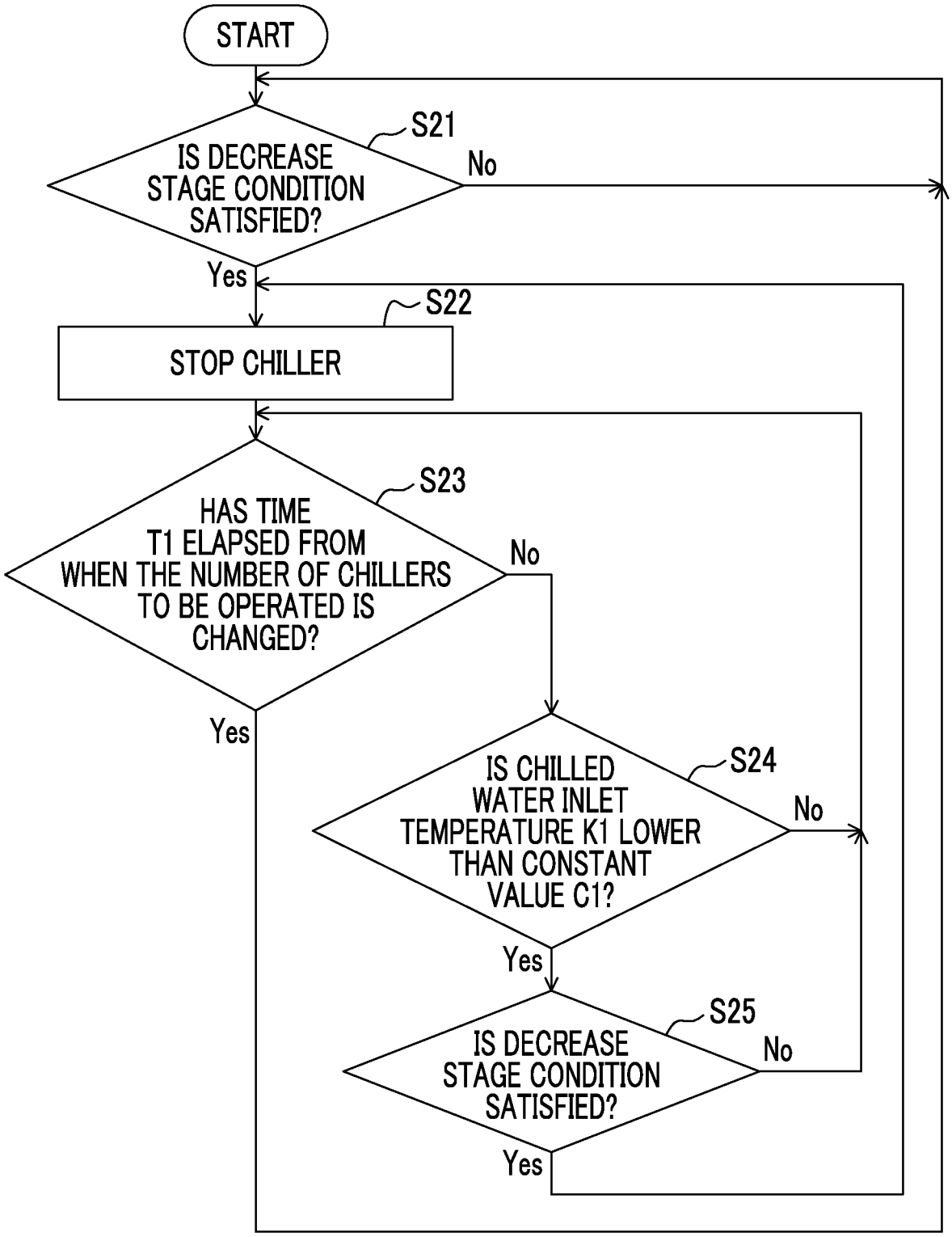
FIG. 4 is a flowchart illustrating an operation example of the control device 20 illustrated in FIG. 1.

Subsequently, a modification example of the operation example of the decrease stage determination unit 212 which is described with reference to FIG. 3 will be described with reference to FIG. 4. FIG. 4 is a flowchart illustrating an operation example of the decrease stage determination unit 212. The modification example illustrated in FIG. 4 differs from the operation example illustrated in FIG. 3 in that the time T2 illustrated in FIG. 3 is set to zero, and thus the process of setting the time T2 in step S15 and the process of determining the elapse of the time T2 in step S16 are omitted. The decrease stage condition and the like are the same as those in the operation example illustrated in FIG. 3.

In the operation example illustrated in FIG. 4, firstly, the decrease stage determination unit 212 determines whether or not the predetermined decrease stage condition is satisfied (step S21). When the predetermined decrease stage condition is not satisfied (in the case of "No" in step S21), the decrease stage determination unit 212 determines whether or not the predetermined decrease stage condition is satisfied in a repeated manner at predetermined periods (step S21).

On the other hand, when the predetermined decrease stage condition is satisfied (in the case of "Yes" in step S21), the decrease stage determination unit 212 transmits a stop signal from the communication unit 22 to stop one of the chillers 11 to 14 which has started (step S22).

Subsequently, the decrease stage determination unit 212 determines whether or not the time T1 (predetermined standby time) has elapsed from when the number of the chillers to be operated is changed (step S23). When the time T1 has elapsed from when the number of the chillers to be operated is changed (in the case of "Yes" in step S23), the decrease stage determination unit 212 again determines whether or not the predetermined decrease stage condition is satisfied (step S21).

On the other hand, when the time T1 has not elapsed from when the number of the chillers to be operated is changed (in the case of "No" in step S23), the decrease stage determination unit 212 determines whether or not the chilled water inlet temperature K1 is lower than the constant value C1, which is the condition for preventing a light load stop (step S24). When the chilled water inlet temperature K1 is not lower than the constant value C1 (in the case of "No" in step S24), the decrease stage determination unit 212 again determines whether or not the time T1 has elapsed from when the number of the chillers to be operated is changed (step S23). When the chilled water inlet temperature K1 is lower than the constant value C1 (in the case of "Yes" in step S24), the decrease stage determination unit 212 determines whether or not the predetermined decrease stage condition is satisfied (step S25). The predetermined decrease stage condition is the same in step S21 and step S25.

When the predetermined decrease stage condition is not satisfied (in the case of "No" in step S25), the decrease stage determination unit 212 again determines whether or not the time T1 has elapsed from when the number of the chillers to be operated is changed (step S23). On the other hand, when the predetermined decrease stage condition is satisfied (in the case of "Yes" in step S25), the decrease stage determination unit 212 transmits a stop signal from the communication unit 22 to stop one of the chillers 11 to 14 which has started (step S22).

The cause of the problem of the present embodiment is that despite that the operation number control device has to originally determine an increase or decrease stage of the chillers, the chilled water inlet temperature decreases to a temperature where the chillers themselves have to perform a stage decrease. In order to prevent this problem, the chillers may be stopped by the operation number control before the chilled water temperature decreases to a threshold value for a light load stop. Therefore, in the present operation example, when the chilled water temperature is the constant value or less, a stage decrease is performed in a state where a standby time condition is not satisfied (without the standby time). Since the standby time for a determination on a stage increase or decrease is reduced, when a plurality of the chillers have to be stopped, it is possible to more quickly stop the chillers, and it is easy to prevent a light load stop.

When the standby time is eliminated, there is a possibility that the operation number control where the loads thereof do not fall within a desired load range is performed. However, since there is a greater risk when a plurality of (all in the worst case) the chillers in operation come to a light load stop, it is desirable that priority is given to the prevention of the light load stop when there is a possibility that the chillers come to the light load stop.

A determination on the light load stop may be performed based on not the chilled water inlet temperature but the chilled water outlet temperature on chillers 11 to 14 sides. In such a case, it may be desirable that the determination is performed when a target which is used as a determination criterion of a light load stop by the chillers is a constant value or less. In addition, when the chillers having different determination criteria are mixed, it is desirable that a determination is performed based on a chiller that is most likely to come to a light load stop.

As described above, according to the present modification example, when the risk of a light load stop is low, the operation number control is performed as usual such that the loads of the chillers fall within the desired load range, and when there is the risk of a light load stop, the number of the chillers to be operated can be instantly reduced by eliminating the standby time.

Figure 5:
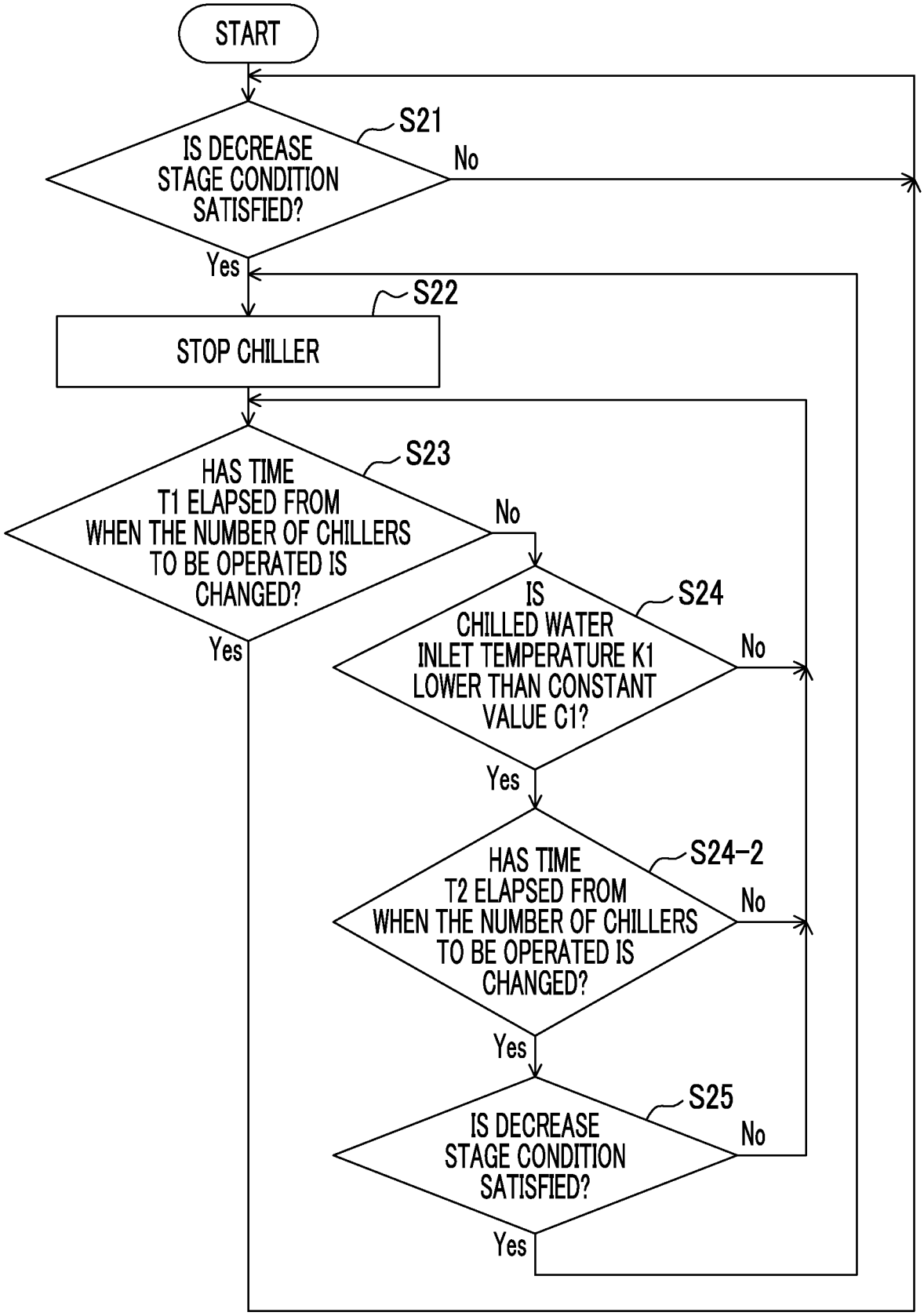
FIG. 5 is a flowchart illustrating an operation example of the control device 20 illustrated in FIG. 1.

Subsequently, an example of further modification of the modification example of the decrease stage determination unit 212 which is described with reference to FIG. 4 will be described with reference to FIG. 5. FIG. 5 is a flowchart illustrating an operation example of the decrease stage determination unit 212. The modification example illustrated in FIG. 5 differs from the operation example illustrated in FIG. 4 in that the process of determining the elapse of the time T2 in step S16 illustrated in FIG. 3 is added as step S24-2. Other processes are the same in FIGS. 4 and 5, and hereinafter, portions in FIG. 5 which are different from FIG. 4 will be described. The decrease stage condition and the like are the same as those in the operation examples illustrated in FIGS. 3 and 4. The time T2 is a fixed value and the setting process (step S15) is omitted.

In the operation example illustrated in FIG. 5, when the chilled water inlet temperature K1 is lower than the constant value C1 (in the case of "Yes" in step S24), the decrease stage determination unit 212 determines whether or not the time T2 has elapsed from when the number of the chillers to be operated is changed (step S24-2). When the time T2 has not elapsed from when the number of the chillers to be operated is changed (in the case of "No" in step S24-2), the decrease stage determination unit 212 again determines whether or not the time T1 has elapsed from when the number of the chillers to be operated is changed (step S23). On the other hand, when the time T2 has elapsed from when the number of the chillers to be operated is changed (in the case of "Yes" in step S24-2), the decrease stage determination unit 212 determines whether or not the predetermined decrease stage condition is satisfied (step S25). The predetermined decrease stage condition is the same in step S21 and step S25.

As described above, according to the present operation example, when the risk of a light load stop is low, the operation number control is performed as usual such that the loads of the chillers fall within the desired load range, and when there is the risk of a light load stop, the number of the chillers to be operated can be reduced in a proper timing by reducing the standby time.

Figure 6:
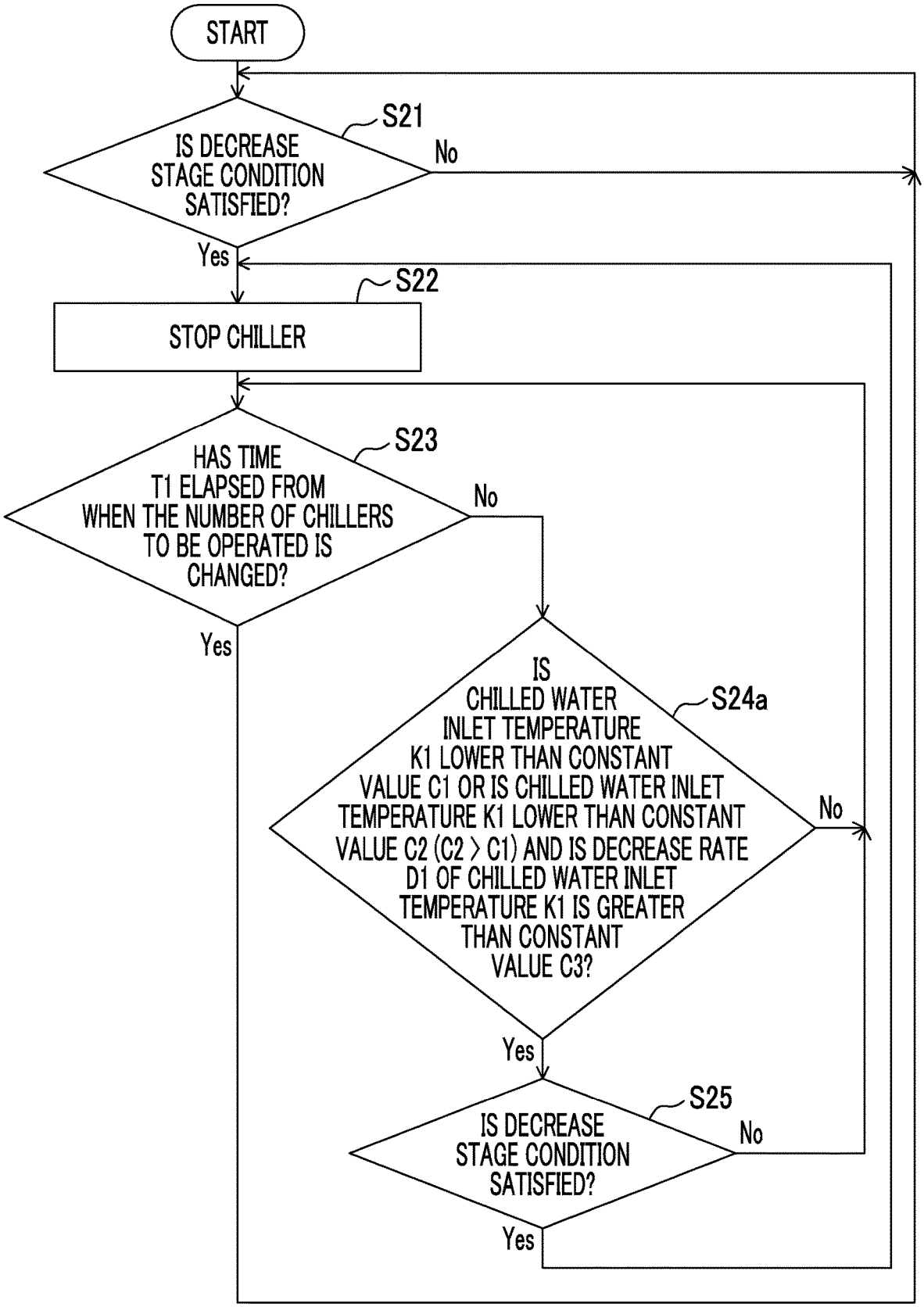
FIG. 6 is a flowchart illustrating an operation example of the control device 20 illustrated in FIG. 1.

Subsequently, another example of further modification of the modification example of the decrease stage determination unit 212 which is described with reference to FIG. 4 will be described with reference to FIG. 6. FIG. 6 is a flowchart illustrating an operation example of the decrease stage determination unit 212. The modification example illustrated in FIG. 6 differs from the operation example illustrated in FIG. 4 in the condition for preventing a light load stop (step S24). In FIG. 6, a determination on the condition for preventing a light load stop is executed in step S24*a*. Other processes are the same in FIG. 4 and FIG. 6, and hereinafter, portions in FIG. 6 which are different from FIG. 4 will be described. The decrease stage condition and the like are the same as those in the operation examples illustrated in FIGS. 3 and 4.

In the operation example illustrated in FIG. 6, when the chilled water inlet temperature K1 is not lower than the constant value C1 and the chilled water inlet temperature K1 is not lower than the constant value C2 (C2>C1) or the decrease rate D1 of the chilled water inlet temperature K1 is not greater than the constant value C3 (in the case of "No" in step S24*a*), the decrease stage determination unit 212 again determines whether or not the time T1 has elapsed from when the number of the chillers to be operated is changed (step S23). On the other hand, when the chilled water inlet temperature K1 is lower than the constant value C1 or the chilled water inlet temperature K1 is lower than the constant value C2 (C2>C1) and the decrease rate D1 of the chilled water inlet temperature K1 is greater than the constant value C3 (in the case of "Yes" in step S24*a*), the decrease stage determination unit 212 determines whether or not the predetermined decrease stage condition is satisfied (step S25).

The operation example illustrated in FIG. 4 is an operation number control logic to perform branching using only the chilled water inlet temperature as a trigger. However, in a case where the decrease speed of the chilled water inlet temperature is very high, even when the chiller is stopped in a state where the chilled water inlet temperature is the constant value or less and the standby time for the operation number control is not satisfied, there is a possibility that the light load stop occurs too late. In order to cope with such a case, in the operation example illustrated in FIG. 6, the decrease rate of the chilled water inlet temperature is also used as a determination criterion for changing the operation number control logic. In this operation example, when the chilled water inlet temperature is a predetermined temperature or less and the decrease rate of the chilled water inlet temperature is a predetermined value or greater, a stage decrease is performed in a state where a standby time condition is not satisfied.

As described above, according to the present modification example, it is possible to prevent a light load stop even when the decrease speed of the chilled water inlet temperature is high.

Figure 7:
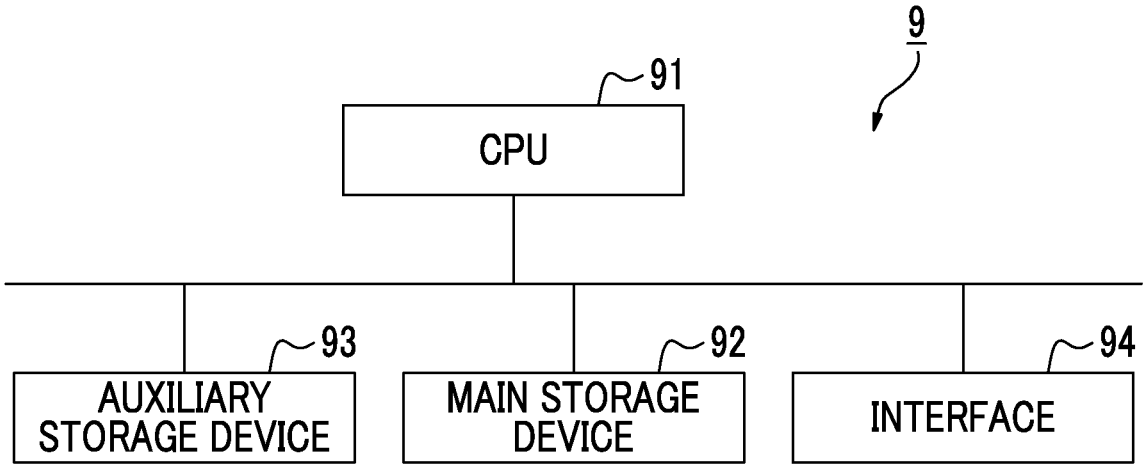
FIG. 7 is a schematic block diagram illustrating the configuration of a computer of the control device 20 illustrated in FIG. 1.

FIG. 7 is a schematic block diagram illustrating the configuration of a computer of the control device 20 according to the foregoing embodiment.

A computer 9 includes a CPU 91, a main storage device 92, an auxiliary storage device 93, and an interface 94.

The control device 20 includes the computer 9. By the way, the operation of each of the foregoing processing units is stored in the auxiliary storage device 93 in the form of a program. The CPU 91 reads the program from the auxiliary storage device 93 to expand the program in the main storage device 92, and executes the foregoing processes according to the program. For example, at least a part of the operation number control unit 21 (the increase stage determination unit 211 and the decrease stage determination unit 212), the communication unit 22, the chilled water temperature acquisition unit 23, and the flow rate acquisition unit 24 which are described above may be the CPU 91.

Examples of the auxiliary storage device 93 include a hard disk drive (HDD), a solid state drive (SSD), a magnetic disk, a magneto-optical disk, a compact disc read only memory (CD-ROM), a digital versatile disc read only memory (DVD-ROM), a semiconductor memory, and the like. The auxiliary storage device 93 may be an internal medium that is directly connected to a bus of the computer 9, or may be an external medium that is connected to the computer 9 via the interface 94 or a communication line. In addition, when the program is delivered to the computer 9 via the communication line, the computer 9 which receives the delivery may expand the program in the main storage device to execute the foregoing processes. In at least one embodiment, the auxiliary storage device 93 is a non-transitory form of storage medium.

The program may realize a part of the foregoing functions. Furthermore, the program may be a so-called differential file (differential program) that realizes the foregoing functions in combination with another program which is already stored in the auxiliary storage device 93.

As described above, the embodiment of the present invention have been described in detail with reference to the drawings; however, the specific configuration is not limited to the embodiment, and includes a design and the like which is made without departing from the concept of the invention.

INDUSTRIAL APPLICABILITY

According to the control device, the chiller system, the control method, and the program which are described above, it is possible to both ensure the stability of operation number control and prevent a light load stop.

REFERENCE SIGNS LIST

1 Chiller system
2 Load
11 to 14 Chiller
71, 72 Temperature sensor
73 Flow rate sensor
20 Control device
21 Operation number control unit
22 Communication unit
23 Chilled water temperature acquisition unit
24 Flow rate acquisition unit
81 Communication line

The invention claimed is:

1. A controller of a chiller system that cools a load using a plurality of chillers, the controller comprising:

a processor and a storage storing a program that causes the processor to perform:

an increasing or decreasing step, increasing or decreasing a number of the chillers among the plurality of chillers to be operated according to a load factor; and an acquiring step, acquiring a chilled water temperature related to at least one of the chillers among the plurality of chillers from a temperature sensor, wherein, in the increasing or decreasing step, the program causes the processor to increase or decrease the number of the chillers among the plurality of chillers to be operated after a predetermined standby time has elapsed from a previous increasing or decreasing step, and reduces the predetermined standby time when at least one of the chilled water temperature and a degree of change in the chilled water temperature satisfies a condition for preventing a light load stop of the plurality of chillers in the predetermined standby time after the number of the chillers among the plurality of chillers to be operated is increased or decreased.

2. The controller according to claim 1, wherein when at least one of the chilled water temperature and the degree of change in the chilled water temperature satisfies the predetermined condition, the program causes the processor to set the predetermined standby time to zero.

3. The controller according to claim 1, wherein, in the increasing or decreasing step, the program causes the processor to determine the predetermined condition based on a set value of the chilled water temperature when a light load stop is executed, which is received from the plurality of chillers.

4. The controller according to claim 3, wherein, in the increasing or decreasing step, the program causes the processor to determine an amount of a reduction in the standby time based on the chilled water temperature, the degree of change in the chilled water temperature, and the set value.

5. The controller according to claim 1, wherein, in the increasing or decreasing step, the program causes the processor to reduce the predetermined standby time when the chilled water temperature is lower than a predetermined set value, as the predetermined condition.

6. The controller according to claim 1, wherein, in the increasing or decreasing step, the program causes the processor to reduce the predetermined standby time when a decrease rate of the chilled water temperature is greater than a predetermined set value, as the predetermined condition.

7. A chiller system comprising:

a plurality of chillers that cool a load; and the controller according to claim 1, wherein the operation number control unit increases or decreases a number of chillers among the plurality of chillers to be operated after the predetermined standby time has elapsed from when the number of the chillers to be operated is increased or decreased, and reduces the predetermined standby time when at least one of the chilled water temperature and the degree of change in the chilled water temperature satisfies the predetermined condition in the predetermined standby time after the number of the chillers to be operated is increased or decreased.

8. A control method using a controller of a chiller system that cools a load using a plurality of chillers, the control method comprising:

an increasing or decreasing step, increasing or decreasing a number of chillers among the plurality of chillers to be operated after a predetermined standby time has elapsed from a previous increasing or decreasing step, and a reducing step, reducing the predetermined standby time when at least one of a chilled water temperature and a degree of change in the chilled water temperature satisfies a predetermined condition in the predetermined standby time after the number of the chillers to be operated is increased or decreased to prevent a light load stop.

9. A non-transitory readable recording medium storing a program that causes a computer, which forms a controller of a chiller system that cools a load using a plurality of chillers, to execute:

an increasing or decreasing step, increasing or decreasing a number of the chillers among the plurality of chillers to be operated after a predetermined standby time has elapsed from a previous increasing or decreasing step, and a reducing step, reducing the predetermined standby time when at least one of the chilled water temperature and a degree of change in the chilled water temperature satisfies a predetermined condition in the predetermined standby time after the number of the chillers to be operated is increased or decreased to prevent a light load stop.

* * * * *